United States Patent [19]

Goldie et al.

[11] 4,395,684

[45] Jul. 26, 1983

[54] R.F. PRIMED PLASMA LIMITER FOR RADAR RECEIVER PROTECTOR

[75] Inventors: Harry Goldie, Randallstown; Suman D. Patel, Silver Spring, both of Md.

[73] Assignee: The United States of America as represented by the Secretary of the Air Force, Washington, D.C.

[21] Appl. No.: 300,762

[22] Filed: Sep. 10, 1981

[51] Int. Cl.[3] ..... H01P 1/14

[52] U.S. Cl. ..... 333/13; 333/17 L

[58] Field of Search ..... 333/13, 17 L, 99 PL; 315/39

[56] References Cited

U.S. PATENT DOCUMENTS

| | | | |
|---|---|---|---|
| 3,023,380 | 2/1962 | Hill | 333/13 |
| 3,048,838 | 8/1962 | Bretscher | 343/17.7 |
| 3,085,239 | 4/1963 | Hoover | 343/5 |
| 3,309,698 | 3/1967 | Baldock | 343/5 |
| 3,396,388 | 8/1968 | Goldie | 343/5 |
| 3,534,298 | 10/1970 | Goldie et al. | 333/13 |
| 4,027,255 | 5/1977 | Blakeney et al. | 333/13 |

OTHER PUBLICATIONS

Cork et al., Abstract of Serial No. 591,588, filed May 2, 1945, Published in 625 O.G. 248, on Aug. 2, 1949.

*Primary Examiner*—Paul L. Gensler

*Attorney, Agent, or Firm*—Donald J. Singer; Willard R. Matthews

[57] ABSTRACT

The plasma switching stage of a radar receiver protector is simplified and improved by the utilization of a halogen gas filled quartz container and a "keepalive" electron source. The container is configured as a capillary stem filled with low pressure chlorine gas and provides the active switching element in the signal waveguide portion of the receiver protector. An enclosed r.f. energy source in combination with the capillary stem creates a copious and steady free electron supply. The r.f. exciting field used to activate the "keepalive" plasma is enhanced by a coaxial re-entrant cavity located on the top wall of the receiver protector waveguide.

5 Claims, 2 Drawing Figures

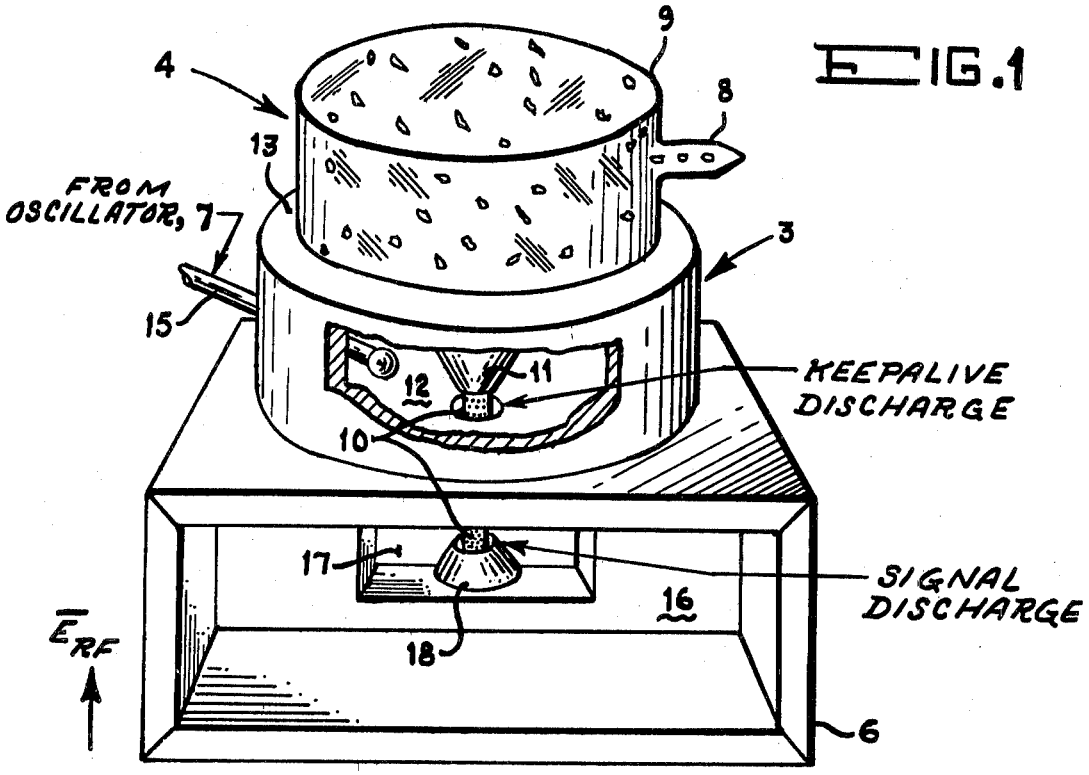
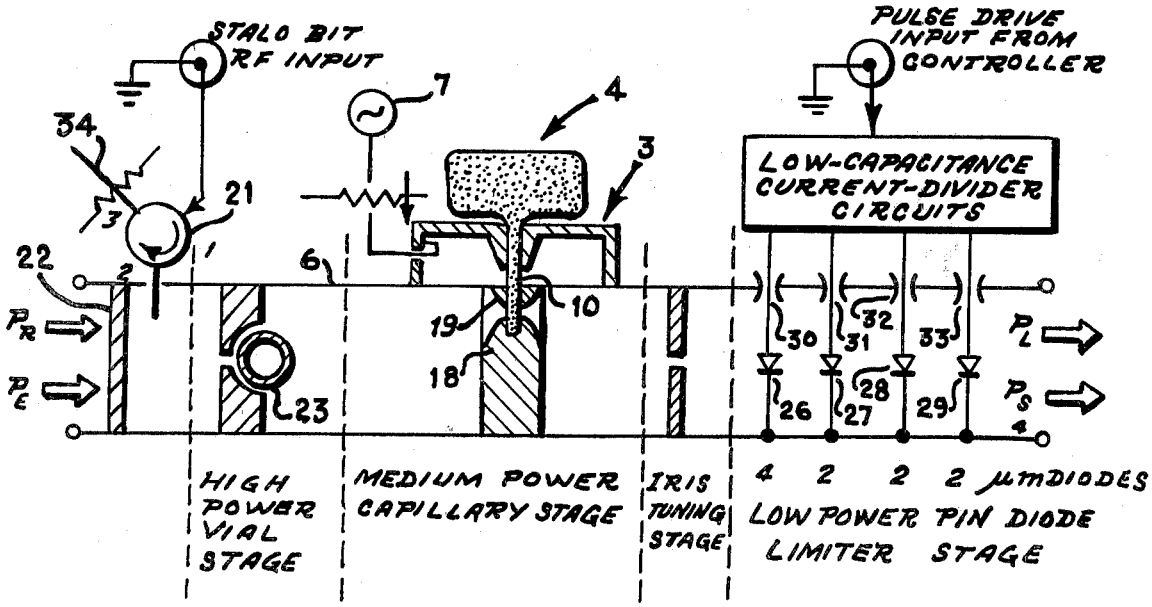
FIG.2

R.F PRIMED PLASMA LIMITER FOR RADAR RECEIVER PROTECTOR

STATEMENT OF GOVERNMENT INTEREST

The invention described herein may be manufactured and used by or for the Government for governmental purposes without the payment of any royalty thereon.

BACKGROUND OF THE INVENTION

This invention relates to radar receiver protectors and in particular to improvements in the plasma limiter stage of such devices.

Receiver protecting in radar systems is commonly accomplished by a device that functions as a high power limiter during the time when the radar is transmitting high power bursts. It prevents the power reflected toward the receiver from the radar antennas from burning out the receiver. When the transmitter burst ceases the radar waits for the weak echo from the target. The weak echo is received by the antenna and passes through the receiver protector. Structurally the receiver protector usually includes a high power vial stage, a medium power plasma stage and a diode low power stage.

The plasma stage of state of the art receiver protectors comprises a section of transmit/receive transmission line that is sealed off by microwave windows and contains a soft fill gas. The soft fill gas is converted to plasma for short circuiting the transmission line by means of a radio active ignitor.

While these state of the art receiver protector components have performed satisfactorily in the past, they suffer from various deficiencies. Furthermore, new advanced applications require performance beyond their capabilities. In particular, soft fill gases suffer from long recovery periods, the radioactive ignitor is undesirable, and special metals, such as Kovar are required for matching expansion coefficients to the microwave windows.

By way of example, one particular receiver protector application that requires performance beyond the capabilities of these prior art devices is found in the new Air Force F16 radar system. The advanced F16 radar system differs from the early F16 radar in the critical area of operating PRF's. The advanced F16 radar employs a duty cycle which is 25 times higher than the early F16 radar. The prior art receiver protector has a 0.7 $\mu$sec recovery period. If this receiver protector is used and the high duty cycle of the new advanced F16 system, its recovery time would be over 1 $\mu$sec. This would result in a significant loss of receiver sensitivity since recovery would encompass a major portion of the receiver listening time.

The present invention is directed toward providing a receiver protector that overcomes the deficencies of prior art devices and that avoids receiver degradation resulting from slow recovery time.

SUMMARY OF THE INVENTION

The invention is a radar receiver protector having an improved plasma limiter stage. The gas utilized is a halogen gas, preferably chlorine, that provides an extremely fast plasma extinguishing period. The chlorine gas is contained in a quartz capillary tube container that keeps the chlorine isolated from the aluminum receiver protector thereby eliminating the need for microwave windows and permitting the fabrication of a cast aluminum plasma limiter stage. A "keepalive" or constant supply of plasma actuating electrons is provided by means of an r.f. primed coaxial re-entrant cavity. The chlorine containing capillary tube is inserted through the coaxial re-entrant cavity and into the receiver protector signal carrying transmission line. The free electrons generated by the re-entrant coaxial cavity provide first pulse gas breakdown thus eliminating the need for the conventional radioactive ignitor. The re-entrant cavity is energized by a cw r.f. signal from a FET oscillator. The re-entrant cavity is configured to have an interior coaxial cone, the apex of which is closely proximate to the bottom cavity wall establishing a gap through which the capillary tube extends and wherein the r.f. electric field is maximum giving effect to the "keepalive" electron supply.

It is a principal object of the invention to provide a new and improved radar receiver protector.

It is another object of the invention to provide a radar receiver protector having an improved plasma limiter stage.

It is another object of the invention to provide a radar receiver protector having an r.f. primed plasma limiter utilizing halogen gas.

It is another object of the invention to provide a radar receiver protector plasma limiter stage that is fabricated of cast aluminum.

It is another object of the invention to provide a radar receiver protector plasma limiter stage that does not require microwave windows.

It is another object of the invention to provide a radar receiver protector plasma limiter stage having an extremely fast recovery period.

It is another object of the invention to provide a radar receiver protector plasma limiter stage that does not require a radioactive ignitor.

It is another object of the invention to provide a radar receiver protector plasma limiter that yields to first pulse breakdown.

It is another object of the invention to provide a radar receiver protector plasma limiter stage that achieves a recovery time of less than 120 nanoseconds at all duty cycles.

These, together with other objects, features and advantages of the invention will become more readily apparent from the following detailed description taken in conjunction with the illustrative embodiment in the accompanying drawings.

DESCRIPTION OF THE DRAWINGS

FIG. 1 is a pictorial illustration of the radar receiver protector plasma limiter of the invention; and FIG. 2 is a schematic illustration of a radar receiver protector incorporating the plasma limiter of FIG. 1.

DETAILED DESCRIPTION OF THE PREFERRED EMBODIMENT

The r.f. primed plasma limiter of this invention is shown, pictorially, in FIG. 1 and its incorporation into a radar receiver protector is illustrated schematically in FIG. 2. Refering to these figures the limiter stage comprises r.f. coaxial re-entrant cavity 3, a closed gas containment system 4, a cw power FET oscillator 7 and a segment 6 of the receiver protector transmission line. R.F. coaxial re-entrant cavity 3 has a top wall 13, a bottom wall 12, an interior coaxial cone 11 and a probe coupler 15 for coupling r.f. energy from oscillator 7.

The apex of cone 11 is proximate to bottom wall 12 establishing a gap therebetween. The electron field within cavity 3 is most intense in the vicinity of this gap. The gas containment system 4 consists of reservoir 9, exhaust tubulation 8 and capillary stem 10. The system is filled with low pressure halogen gas, preferably chlorine. It is fabricated of quartz or other suitable material for containing halogen gases. Waveguide segment 6 is incorporated into the receiver protector as shown in FIG. 2. Cavity 3 is mounted on the top wall of waveguide segment 6 as shown, and capillary stem 10 of the gas containment system is inserted through the cone of reentrant cavity 3 and into waveguide segment 6. Waveguide segment 6 includes partition 16 and capillary stem 10 is terminated within the aperture 17 of partition 16 by means of cones 18 and 19 in accordance with standard receiver protector design practices. FIG. 2 illustrates, schematically, a radar receiver protector incorporating the r.f. primed plasma limiter of the invention. Other than the medium power capillary stage described above the device is conventional and includes TIFG window 22, MIC inject circulator 21, vial 23, power load 34, diodes 26–29, and re-entrant coupling chokes 30–33. $P_R$ designates reflected power from the antenna during transmit, $P_E$ designates echo signal during receive period, $P_L$ designates flat leakage and $P_S$ designates spike leakage.

In operation, coaxial re-entrant cavity 3 accepts a signal from the CW power FET microwave oscillator 7 and excites the auxiliary (keepalive) discharge gap. The gap is formed by the flat cavity wall 12 and the re-entrant cone 11 containing the quartz capillary stem 10. As indicated above, the stem 10 connects to the low pressure chlorine filled quartz gas reservoir 9 and extends into the signal guide 6 where it acts as the active switching element. The stem 10, being common to the signal waveguide and the auxiliary discharge gap, experiences free electrons drifting toward the signal discharge gap, thus providing first pulse gap breakdown. Because first pulse gas breakdown is achieved at any duty cycle the radioactive ignitor used in prior art devices is not required; thus no soft-fill gases need be used. Soft gases suffer from long recovery period.

An important feature of the invention is the substitution of chlorine gas for water vapor-argon gases in the low power gas limiter stage. The use of chlorine gas provides the fastest attainable plasma extinguishing period for a given rf excitation level. Chlorine cannot be allowed to touch metal surfaces because of gas cleanup. Consequently, it is not possible to use a radioactive $T_iH^3$ ignitor in contact with the halogen gas. Advantages of the invention beside the fast turnoff period are that no microwave windows are needed to form a vacuum cell thus reducing insertion losses; and, that no special metals such as Kovar are necessary for matching expansion coefficients to glass windows. These advantages make it possible for the plasma limiter stage to be made of cast aluminum.

By way of example, a receiver protector utilizing the invention as the second plasma limiter stage of a receiver protector has been built and tested in X-band as shown in FIG. 2. The first stage was a conventional high power vial stage, the second stage the r.p. primed plasma limiter of the invention and the last four stages a conventional solid state limiter/STC.

Tests performed at X-band frequencies showed that excellent receiver protection was achieved: under 75 peak mW spike (B) and under 2 mw peak flat ($P_2$) leakage was achieved for 0 to 2500 peak watts incident. With 1000 watts incident and the four diode STC gated to high attenuation level the leakage power was 100 mw for a gated isolation of 100 dB. One dB recovery period was under 120 nanoseconds for all duty cycles. Mid-band insertion loss was 0.60 dB for typical radar bandwidths (6%). Interaction loss was under 0.02 dB and noise generated was 30° K.

The bulk resonator oscillator 7 was fabricated on E-10 soft substrate using an MSC 88004 power FET. It generated 325 milliwatts cw at 6.1 GHz through a ferrite isolator into the cavity 3 with a $Q_1=30$. Threshold for the keepalive gap discharge was 250 mw cw. The power FET oscillator circuit descibed is characterized by its small size and is especially suited to the invention. Its advantages include the ability to be included within the receiver protector envelope and its operating compatibility to the receiver protector.

It is noted that only two plasma limiter stages are needed because of the reliability of early breakdown in the first pulse. With the graded diode concept (now conventional) combined with this reliable breakdown, one plasma stage can be eliminated from equivalent waveguide designs of equal power levels.

The r.f. primed plasma limiter described herein gives effect to a new type radar receiver protector that provides:

(a) steady supply of free electrons in a halogen discharge by using an rf discharge in a high-Q gravity;
(b) eliminates the radioactive igniter and the dc ignitor;
(c) provides an all-halogen plasma limiter which yields first pulse breakdown;
(d) allows an all-aluminum cast RP and eliminates microwave resonant windows and special metals for temperature expansion matching such as Kovar and Fernico; and,
(e) Achieves a fast recovery time (1−dB) of less than 120 nanoseconds at all duty cycles which enhances the receiver sensitivity.

While the invention has been described in one presently preferred embodiment it is understood that the words which have been used are words of description rather than words of limitation and that changes within the purview of the appended claims may be made without departing from the scope and spirit of the invention in its broader aspects.

What is claimed is:

1. In a radar receiver protector having a microwave transmission line for transmitting and receiving radar signals the improvement residing in an r.f. primed plasma limiter, said r.f. primed plasma limiter comprising an r.f. re-entrant cavity mounted on the exterior surface of said microwave transmission line, means for establishing an r.f. electric field in said re-entrant cavity, and a container filled with halogen gas inserted through said re-entrant cavity and into said microwave transmission line, whereby interaction of said r.f. electric field and said halogen gas generates a continuous supply of electrons in said halogen gas, said electrons diffusing from the re-entry cavity region to the microwave transmission line region and enabling plasma breakdown of said halogen gas in response to radar signal pulses propagating through said transmission line.

2. An r.f. primed plasma limiter as defined in claim 1 wherein said halogen gas is chlorine.

3. An r.f. primed plasma limiter as defined in claim 2 wherein said microwave transmission line is a rectangular waveguide, said re-entrant cavity is mounted on the top surface thereof and is configured as a cylindrical structure having planar top and bottom walls and a coaxial conical member on the inner surface of said top wall, the apex of said conical member and said bottom wall being proximate and establishing a gap therebetween, said re-entrant cavity including a microwave probe, said means for establishing an r.f. electric field comprises an r.f. signal source for generating an r.f. signal, said r.f. signal being fed to said microwave probe, and said container filled with halogen gas is configured as a reservoir member filled with low pressure chlorine and having a chlorine filled tubular extension, said reservoir and tubular extension forming an integrated closed system, said tubular extension being inserted through said coaxial conical member and through said gap and into said rectangular wavewguide.

4. An r.f. primed plasma limiter as defined in claim 3 wherein said r.f. signal source comprises a cw power field effect transistor oscillator.

5. An r.f. primed plasma limiter as defined in claim 4 wherein said reservoir member and said tubular extension are fabricated of quartz.

* * * * *